US005575219A

United States Patent [19]

Herring

[11] Patent Number: 5,575,219

[45] Date of Patent: Nov. 19, 1996

[54] CLOTHES BASKET COMBINATION

[76] Inventor: David M. Herring, Rte. 2, Box 1780, Cushing, Okla. 74023

[21] Appl. No.: 398,876

[22] Filed: Mar. 6, 1995

[51] Int. Cl.[6] ..... B61B 3/00

[52] U.S. Cl. ..... 105/151

[58] Field of Search ..... 105/148–152; 104/89–93, 112, 113; 294/67.1, 67.2, 67.22, 67.3, 67.4, 67.41, 148–155; 217/125; 220/22.3

[56] References Cited

U.S. PATENT DOCUMENTS

| | | | |
|---|---|---|---|
| D. 169,406 | 4/1953 | Zajac | D49/1 |
| 814,933 | 3/1906 | Bendickson | 105/150 |
| 844,641 | 2/1907 | Yeakel | 105/89 |
| 1,459,115 | 6/1923 | Pedersen . | |
| 2,358,767 | 9/1944 | Breslav | 294/67 |
| 3,026,816 | 3/1962 | Russo | 104/113 |
| 3,760,742 | 9/1973 | Roloff | 105/151 |
| 4,981,232 | 1/1991 | Wynn | 220/532 |

*Primary Examiner*—Robert J. Oberleitner
*Assistant Examiner*—C. T. Bartz
*Attorney, Agent, or Firm*—Robert E. Massa

[57] ABSTRACT

A clothes basket combination adapted for movement along a clothes line by means of attachment of a basket component to a pulley device which is adapted for movement along the clothes line. The pulley device includes a downwardly depending arm substantially centered below the pulley device. The clothes basket includes adjustable strap means connecting the clothes basket to the pulley device. The combination also includes a removable clothes pin container adaptable for attachment on a side of the clothes basket.

11 Claims, 2 Drawing Sheets

CLOTHES BASKET COMBINATION

FIELD OF THE INVENTION

My invention relates to a clothes basket combination adapted for movement along a clothes line. More particularly, my invention relates to a clothes basket combination which includes a pulley device adapted for movement along a clothes line. Still more particularly, my invention relates to a clothes basket combination which is adjustably connectible to the pulley device by means of adjustable straps. Still more particularly, I have designed my clothes basket combination to include a removable clothes pin container to further ease the housewife's task.

BACKGROUND OF THE INVENTION

In the most simple action, a housewife must carry a basket of wet clothing from a washing machine to an area outside her house to a place beside a clothes line while she hangs her clothing on the clothes line.

In such activity she must then lift the basket of clothing and move it to a further position beside the clothes line while she hangs the next few items of clothes.

Various attempts have been made to ease and simplify the task of hanging clothes on a clothes line. However, I believe that after the long time and effort I have given this problem, that I have provided a new system which is extremely convenient to a housewife who needs to hang her wet clothing on her outside clothes line.

I have designed my clothes basket combination to be adaptable for many practical purposes.

First of all, in contrast to the statement I made above regarding the most simple action in hanging clothes, the housewife who has access to a clothes basket combination such as mine, can benefit from many advantages it provides:

1. The clothes basket combination can be placed at a convenient place on the clothes line within her handy reach as she pleases.

2. The clothes basket combination can be placed movably on the clothes line instead of having to be placed on the ground.

3. The clothes basket combination includes adjustable straps which permit the housewife to adjust the height of the basket as she sees fit.

4. The housewife may, if she wishes, leave the clothes basket combination on the clothes line after she has hung her wet clothes on the line so that she will have the clothes basket combination in easy access for placing therein the dry clothes which she later removes from the line.

5. The clothes basket combination can be easily taken inside the house by the housewife and placed near the washing machine.

6. The housewife may make even further convenient use of this clothes basket combination by having a line stretched from near her house to the clothes line in order to further reduce the carrying of the clothes basket.

During the consideration of my invention, I had a prior art search made which revealed the following patents:

| | | |
|---|---|---|
| U.S. Pat No. 1,459,115 | Pedersen | June 19, 1923 |
| U.S. Des. 169,406 | Zajac | April 21, 1953 |
| U.S. Pat. No. 3,760,742 | Roloff | Sept. 25, 1973 |

U.S. Pat. No. 1,459,115 to Pedersen, describes a clothes line support which is used to connect two clothes lines, such as an upper portion and a lower portion, in a manner that when clothes are suspended from the lower line it is desirable to support the lower line from the upper line to make the device more rigid.

U.S. Pat. No. 169,406 to Zajac, describes an ornamental form of clothes line support.

U.S. Pat. No. 3,760,742 to Roloff, describes a clothes basket hanger comprising a frame device of light weight tubular construction attached to trolley means comprising a pair of plate members each having a wheel element thereon for engaging the clothes line. The frame device includes a pair of horizontal arms for supporting a clothes basket placed thereon.

SUMMARY OF THE INVENTION

The primary object of my invention is to provide a clothes basket combination which is light weight, easy to handle, and simple to operate.

Another object of my invention is to provide a clothes basket combination which is easy and economical to manufacture, and easy to sell.

Still another object of my invention is to provide a clothes basket combination which is easy and simple for the housewife to place upon and remove from a clothes line.

Still another object of my invention is to provide a clothes basket combination which may be easily placed in a storage area by the housewife.

Still another object of my invention is to provide a clothes basket combination which may be easily adjustable on the clothes line by the housewife to a height which is most suitable to her.

Still another object of my invention is to provide a clothes basket combination which is sturdy and compact.

I have developed my clothes basket combination primarily for the benefit of the housewife and believe that I have considered every facet of construction to make her task easier.

My device may be easily and quickly placed upon and removed from a clothes line as I stated above. And, as I suggested, if the housewife wants to make her task even easier, she may construct a line from a pole or connection near her house to her clothes line so that she may place a basketful of wet clothes on that line and roll it to the actual clothes line. Then, she may transfer the clothes from the clothes basket to the clothes line.

My design of the pulley device, by using a single pulley, along with the downwardly extending arm centered substantially below the line, and the cross member secured thereto, and the four straps, provide the strength and balance which I was seeking.

I have achieved this balance by combining the design of just a few components in a special weight distributing manner, while at the same time providing a light weight, sturdy product.

I have revised a clothes basket combination adapted for movement along a clothes line comprising a pulley device including a hanger supporting the pulley device rotatably along the clothes line and including a downwardly depending arm substantially centered below the pulley device and a clothes basket having means for adjustably attaching the basket to the arm, said means for adjustably attaching the basket to the arm includes a cross member secured to the arm which enhances the balance of the clothes basket combination when the apparatus is placed on a clothes line.

The above objects and advantages of my invention will become apparent from my description of the following preferred embodiments of my invention.

DESCRIPTION OF THE PREFERRED EMBODIMENTS

Figure 1:
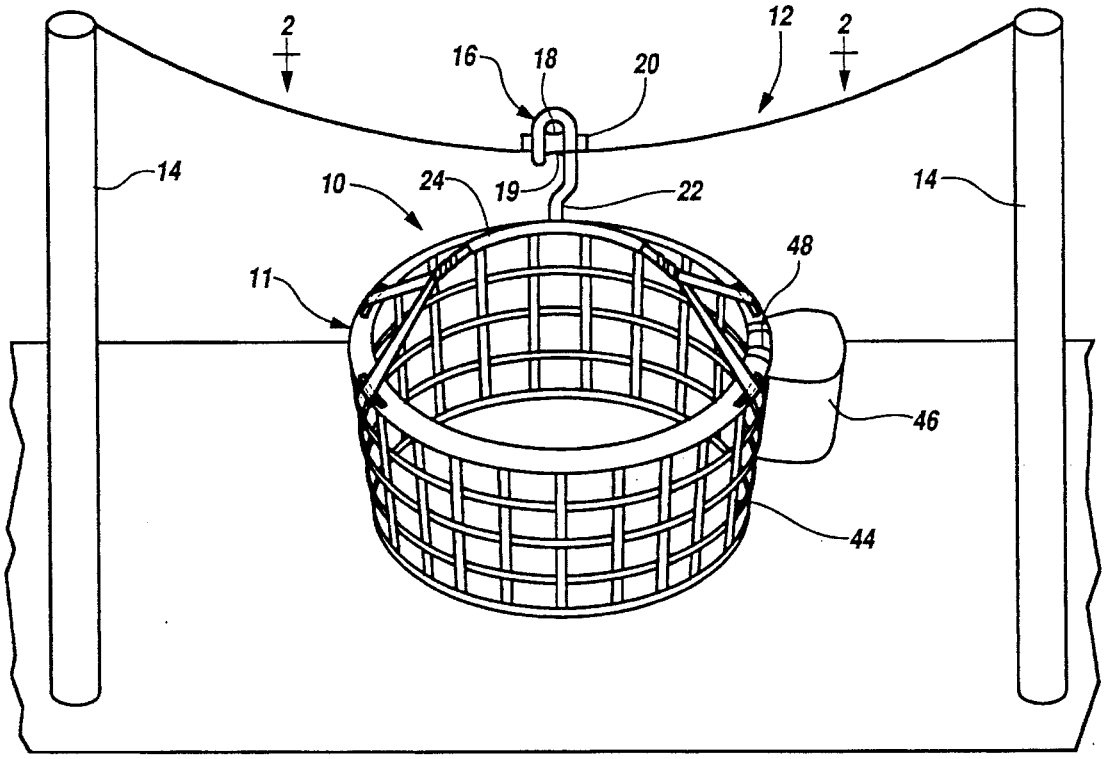
FIG. 1 is a perspective view of a clothes basket combination according to my invention illustrating the manner of mounting the clothes basket combination on a typical clothes line.

FIG. 1 is a perspective view of a clothes basket combination 10, generally, including a clothes basket 11, generally, as it would be placed in operation along a clothes line 12 stretched between two clothes poles 14.

As I mentioned above, the clothes basket combination 10 includes a pulley device 16, generally, which comprises a small wheel 18, generally, having around it a small groove 19 adaptable to fit upon the clothes line 12. Wheel 18, generally, is supported within the pulley device 16 by a pin 20.

I have designed the pulley device 16 to have the wheel 18 mounted in a hanger component 21, generally, which provides means for easily mounting the wheel 18 above the clothes line 12.

The hanger 21, generally, is curved to a position below the clothes line 12 where it becomes a downwardly depending arm 22 substantially centered, after mounting of the pulley device upon the clothes line, below the pulley device 16. This design enhances the stability and balance of the clothes basket combination.

The pulley device 16 further includes a curved cross member 24 secured to the arm 22 in a manner that the cross member even more increases the stability and balance of the clothes basket combination.

Figure 4:
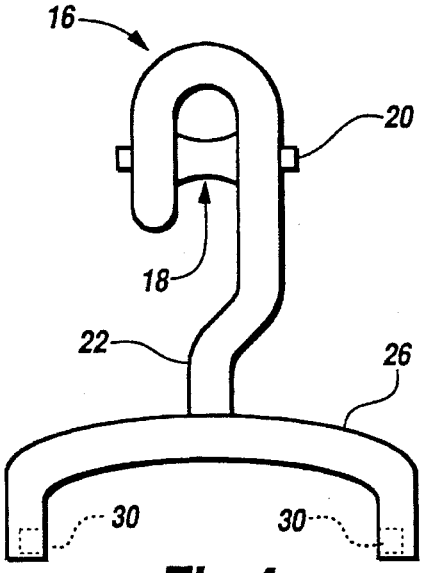
FIG. 4 is a side view of an alternate form of pulley device according to my invention.

I have found, and describe in my drawings, that there are two types of cross members which are suitable to use with my device. I have described above the curved cross member 24. Then, in FIG. 4, I show a straight cross member 26.

Each cross member 24 and 26 is preferably a flat metal structure. Then, near each end of cross member 24 is a slot 28 on the bottom thereof, and likewise near each end of cross member 26 is a slot 30 on the bottom thereof.

The slots 28 and 30 provide means for the wrap-around adaptation of straps 32. The straps 32 are of flexible material, most suitably of webbed Nylon fabric, preferably of ¾" or 1" width, which is strong enough to support a basket fully loaded of wet clothes.

Figure 3:
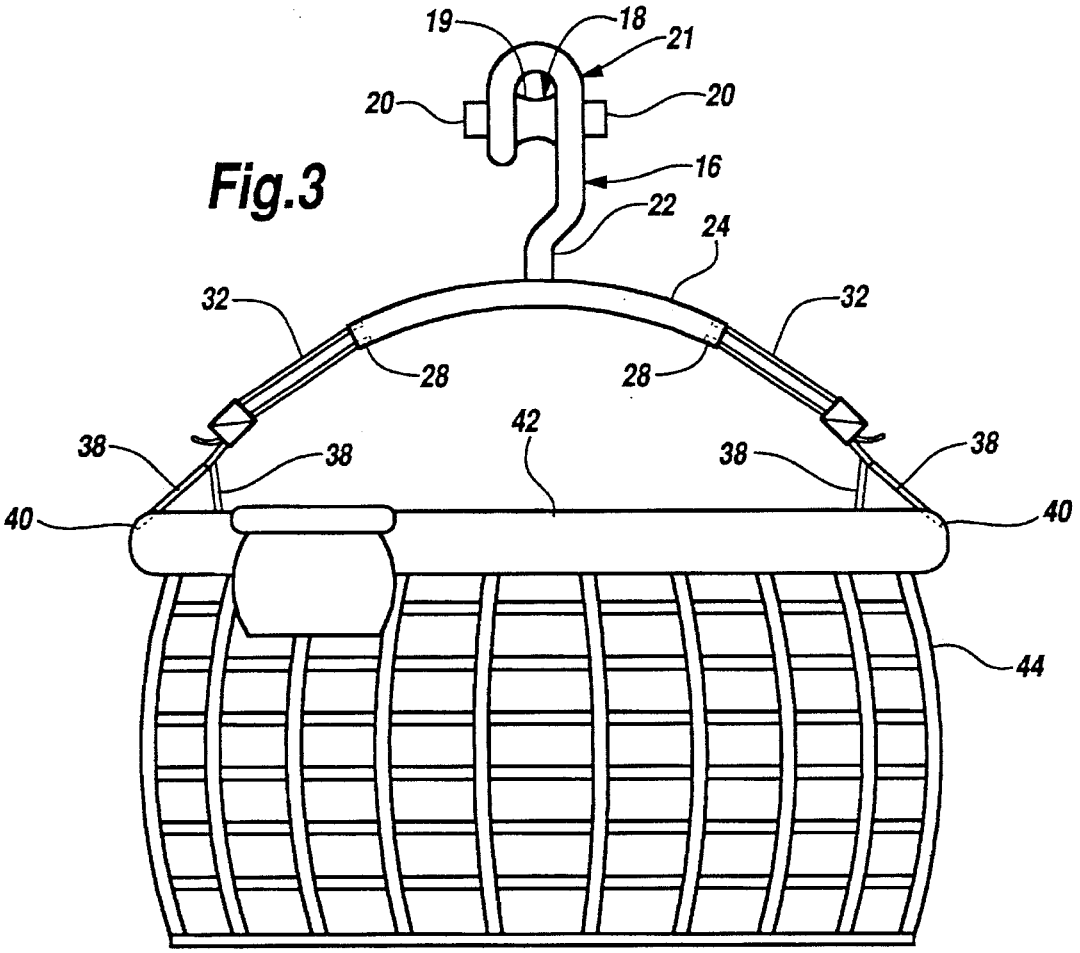
FIG. 3 is a side view of a clothes basket combination according to my invention along the lines 3—3 of FIG. 2.

As I show in FIG. 3 the wrap-around provision of the straps 32 provides a means for adjusting the length of the straps in cooperation with buckles 34 through which one portion of each strap passes adjustably therethrough while an end of the strap is secured within each buckle. Each buckle 34 includes means therein (not shown) for releasing and adjusting the buckle with the strap. Thus, the housewife may shorten or lengthen the straps to position the clothes basket as she sees fit.

At the opposite end, buckle 34 is secured with another flexible strap 36 which is then secured to additional straps 38. The means for securing the straps usually involves the simple act of sewing the straps in place. As I show in FIGS. 2 and 3, straps 36 are secured to straps 38.

Each strap 38 passes through a slot 40 in rim 42 of basket 11. For suitable balance there should be at least four slots 40 in the clothes basket 11. Then, preferably, each strap 38 is made secure by being folded back upon the body of the strap and sewn thereon.

Straps 36 and 38 should also be of the same material as strap 32.

I prefer clothes basket 11 to be of open plastic material 44 as I show in FIG. 1 and FIG. 3. The bottom may be either of a solid component or may also be of open material. With open structure the clothes basket 11 acquires added aeration which should enhance the drying of clothes contained therein.

As I mentioned above, I have provided my clothes basket combination 10 with a removable clothes pin container 46, generally, which is adaptable to fit upon the rim 42 of the clothes basket 11 by means of arms 48 which loop over the rim 42.

Figure 2:
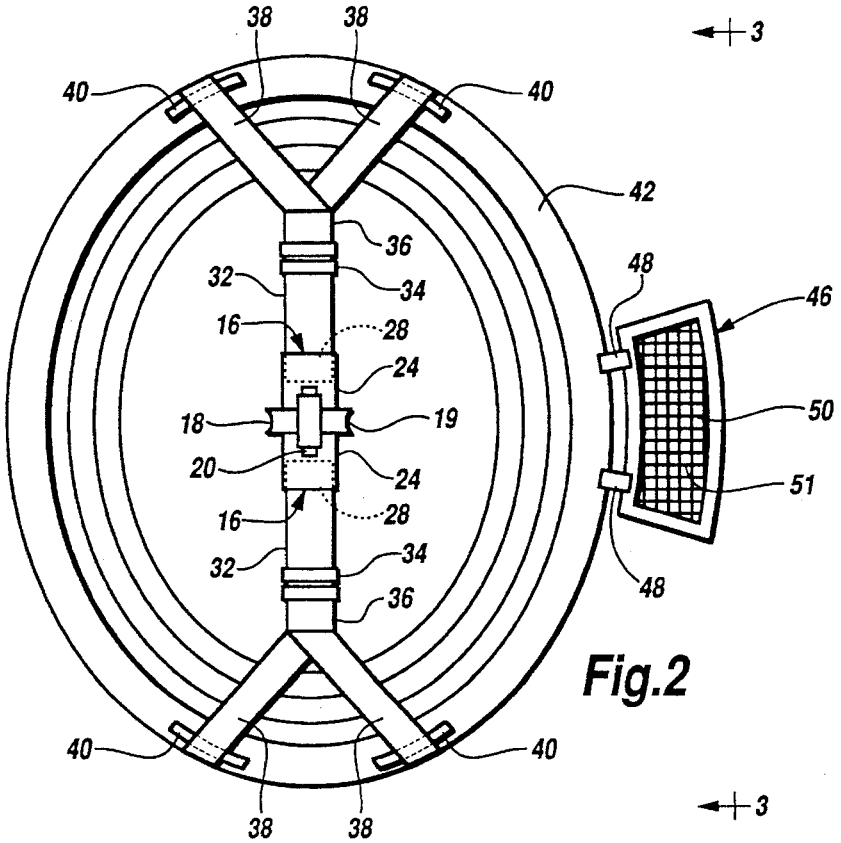
FIG. 2 is a top view of a clothes basket combination according to my invention along the lines 2—2 of FIG. 1.

In FIG. 2 I describe a clothes pin container 46 of plastic material having solid sides with bottom 50 having holes 51 therein. The open bottom structure 50 of clothes pin container 46 permits the drainage of any water which might have accumulated within it.

Figure 5:
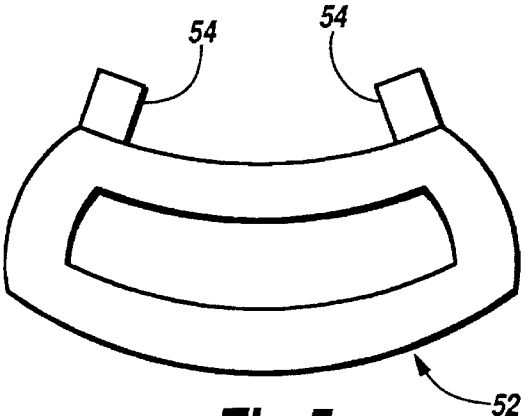
FIG. 5 is a top view of an alternate form of clothes pin holder according to my invention.

Then, in FIG. 5, I describe another form of clothes pin container 52, generally, which is of solid plastic material and also includes a pair of arms 54.

Both clothes pin containers 46 and 52 should be curved in order to fit the curvature of clothes basket 11, as I show.

Thus, I believe that I have described the essential components of my invention and the manner in which they cooperate to provide the housewife with a very useful device.

Since many different embodiments of my invention may be made without departing from the spirit and scope thereof, it is to be understood that the specific embodiments described in detail herein are not to be taken in a limiting sense, since the scope of the invention is best defined by the appended claims.

I claim:

1. A clothes basket combination adapted for movement along a clothes line, comprising:

a pulley device adapted for movement along the clothes line, said pulley device including a hanger for the pulley device supporting the pulley device rotatably and including a downwardly depending arm substantially centered below the pulley device, a clothes basket having means for adjustably attaching the clothes basket to the aforesaid arm, said means for adjustably attaching the clothes basket to the aforesaid arm includes a cross member secured to the arm, said cross member is secured substantially transversely of the aforesaid pulley, and said cross member includes means at each end for attaching a basket support line thereto.

2. A clothes basket combination as described in claim 1, wherein:

the basket support line includes means for adjusting the length of the support line near each end of the basket support line.

3. A clothes basket combination as described in claim 2, wherein:

the means for adjusting the length of the support line includes a buckle.

4. A clothes basket combination as described in claim 3, wherein:

the buckle near each end of the basket support line is secured to another line which is further secured to two extending lines, each secured to the basket.

5. A clothes basket combination as described in claim 4, wherein:

the cross member is slightly curved downwardly from the arm.

6. A clothes basket combination as described in claim 5, wherein:

the clothes basket includes a set of four slots through each of which an extending line is secured.

7. A clothes basket combination as described in claim 6, wherein:

the combination includes a single pulley device.

8. A clothes basket combination as described in claim 7, wherein:

the combination includes a clothes pin container attachable to a side of the clothes basket.

9. A clothes basket combination as described in claim 8, wherein:

the clothes pin container is curved to fit the curvature of the clothes basket.

10. A clothes basket combination as described in claim 9, wherein:

the clothes pin container has an open structure to permit drainage of any water accumulating therein.

11. A clothes basket combination as described in claim 9, wherein:

the clothes pin container has a solid structure.

* * * * *